US005437810A

United States Patent [19]

Ewbank et al.

[11] Patent Number: 5,437,810

[45] Date of Patent: Aug. 1, 1995

[54] AQUEOUS LIQUID DETERGENT COMPOSITIONS CONTAINING OXIDIZED POLYSACCHARDIES

[75] Inventors: Eric Ewbank, Brussels; Geneviève Jonlet, Hermalle; Hoai-Chau Cao, Liege, all of Belgium

[73] Assignee: Colgate-Palmolive Co., New York, N.Y.

[21] Appl. No.: 233,661

[22] Filed: Apr. 26, 1994

[51] Int. Cl.[6] ..... C11D 1/12; C11D 1/755; C11D 17/00

[52] U.S. Cl. ..... 252/174.17; 252/174.18; 252/550; 252/554; 252/173; 252/174.23; 252/DIG. 2; 252/DIG. 14

[58] Field of Search ..... 252/174.17, 174.18, 252/550, 554, 173, 174.23, DIG. 2, DIG. 14

[56] References Cited

U.S. PATENT DOCUMENTS

| | | | |
|---|---|---|---|
| 3,665,000 | 5/1972 | Hills et al. | 260/233.3 R |
| 4,715,969 | 12/1987 | Rothanavibhata et al. | 252/8.7 |
| 4,797,223 | 1/1989 | Amick et al. | 252/174.23 |
| 4,931,195 | 6/1990 | Cao et al. | 252/8.8 |
| 5,248,445 | 9/1993 | Rizvi et al. | 252/174.15 |
| 5,298,180 | 3/1994 | Dixit | 252/94 |

FOREIGN PATENT DOCUMENTS

| | | |
|---|---|---|
| 2028284 | of 1992 | Canada . |
| 301892 | 2/1989 | European Pat. Off. . |
| 542496 | 5/1993 | European Pat. Off. . |
| WO91/09109 | 6/1991 | WIPO . |

*Primary Examiner*—Paul Lieberman
*Assistant Examiner*—Patricia Hailey
*Attorney, Agent, or Firm*—Bernard Lieberman; Robert C. Sullivan

[57] ABSTRACT

An aqueous heavy duty liquid detergent composition of controlled viscosity is disclosed. The composition comprises a homogeneous mixture of at least one water soluble anionic organic detergent, at least one detergent builder, an oxidized polysaccharide viscosity control agent, an optional salt of an acrylic polymer as a supplementary viscosity control agent, an optional clay fabric softener and water. The composition is characterized as having a considerably lower initial viscosity than compositions which do not contain the viscosity modifier and exhibit a stability or even a diminution of the initial low viscosity after prolonged storage. As a result, heavy duty liquid detergent compositions having good flowability and stability are provided.

22 Claims, No Drawings

AQUEOUS LIQUID DETERGENT COMPOSITIONS CONTAINING OXIDIZED POLYSACCHARDIES

BACKGROUND OF THE INVENTION

1. Field of the Invention

This invention relates to aqueous liquid detergent compositions containing an oxidized polysaccharide component as a viscosity controlling agent.

2. Description of the Related Art

Heavy duty liquid detergents useful for machine washing of laundry are well known materials which have been described in a number of patents and in the literature. They are generally aqueous compositions comprising at least one or a compatible mixture of two or more detergent active surfactants selected from anionic, cationic, nonionic, zwitterionic and amphoteric species. Such compositions also generally contain detergency builder components and/or sequestering agents such as inorganic phosphates or phosphonates, alkali metal carbonates, alkali metal aminopolycarboxylates such as salts of nitrilotriacetic acid and salts of ethylenediamine-tetraacetic acid, alkali metal silicates, aluminosilicates, various zeolites and mixtures of two or more of these. Other components which may be present in such compositions include a clay material such as bentonite present as a fabric softener, optical brighteners, enzymes and their stabilizers, perfumes, colorants, antifoaming agents, e.g. silicone compounds, preservatives and like known additives.

One of the problems associated with such aqueous liquid detergent compositions is that they tend to be of initially high viscosity or tend to thicken after storage for a period of time thereby markedly decreasing the flowability of the compositions from the containers in which they are packaged. The flow problem is compounded with respect to compositions containing dispersed solid materials such as bentonite clay fabric softener and dispersed builders, and compounded even more where super concentrated detergent compositions containing less than about 50% by weight water are prepared.

The problem of viscosity control with respect to liquid detergent compositions has been addressed in a number of issued patents. For example, U.S. Pat. No. 4,715,969 and its counterpart UK 2,168,717 disclose that the addition of less than about 0.5% by weight of a polyacrylate polymer, e.g. sodium polyacrylate, having a molecular weight from about 1,000 to 5,000 to aqueous detergent compositions containing primarily anionic surfactants will stabilize the viscosity of the composition and prevent a major increase in viscosity after a period of storage of the formulated composition.

A disadvantage associated with the use of such polymeric viscosity stabilizers at relatively high levels is that they are not readily biodegradable after discharge into the environment.

PCT publication WO 91/09109 (EP 90/01962) addresses the problem of biodegradability of aqueous detergent compositions containing a dispersion of lamellar droplets of detergent active material and a polymeric suspending agent. The disclosure teaches the use of a biodegradable deflocculating polymer such as modified polysaccharide containing hydrophobic side chains as the suspending polymer, preferably a modified dextran polymer having a molecular weight in the range of from about 2,000 to 20,000.

In addition, Canadian patent 2,028,284 discloses powder detergent compositions containing a combination of phosphate salts and a zeolite material as sequestering agents, and further containing from about 5 to about 40% by weight of an oxidized polysaccharide, based on the weight of phosphate, zeolite and oxidized polysaccharide. The oxidized polysaccharide is disclosed to be biodegradable and to have sequestering (co-builder) properties which compliment the builder properties of the phosphates and zeolites, thereby allowing a reduction of the content of these latter materials in the laundry composition. A similar disclosure if found in Canadian patent 2,038,460.

There still exists a need in liquid detergent technology to provide aqueous formulations which contain a higher level of payload, i.e., active ingredients, while at the same time minimizing viscosity or viscosity build up associated with such highly concentrated formulations. This need is particularly acute with respect to phosphorus-free compositions containing non-water soluble detergent builders and clay softeners.

SUMMARY OF THE INVENTION

The present invention provides a stable, free flowing aqueous heavy duty liquid detergent compositions having a viscosity in the range of from about 1,000 to 20,000 cps, more preferably from about 2,000 to 10,000 cps, comprising a homogenous mixture of:

a) at least one water soluble, anionic, sulfate or sulfonate organic detergent;
b) at least one detergent builder;
c) from about 0.25 to about 5% by weight of an oxidized polysaccharide viscosity modifier having an acid index value of from about 1 to 20;
d) from 0 to about 1.5% by weight of an alkali metal salt of an acrylic polymer having a mass molecular weight in the range of from about 500 to 10,000; and
e) from about 25 to 70% by weight water.

The invention also provides for a method of reducing the viscosity Of heavy duty, aqueous based liquid detergent compositions containing at least one anionic detergent and at least one detergent builder, comprising mixing into said compositions a viscosity modifier composition containing an oxidized polysaccharide having an acid index of from about 1 to 20, alone or mixed with an alkali metal salt of an acrylic polymer, in an amount effective to reduce the viscosity of said detergent composition.

Particularly preferred compositions are phosphate-free and contain water insoluble detergent builders such as alumniosilicate zeolites and dispersed clay as a softening agent. The more preferred viscosity modifier comprises the oxidized polysaccharide alone, or mixed with at least 0.05% by weight of the alkali metal salt of an acrylic polymer.

Detergent compositions of this invention are characterized as having a considerably lower initial viscosity than similar compositions which do not contain the viscosity modifier composition and exhibit a stability of, or even a diminution of the initial low viscosity after prolonged storage. As a result, heavy duty liquid detergent compositions having good flowability and stability are provided.

DETAILED DESCRIPTION OF THE INVENTION

The detergent composition of the invention contains one or a mixture of anionic sulfate or sulfonate organic detergents. Suitable anionic detergents are the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glyceryl ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived by reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates, which term is used to describe the material made by reacting olefins, particularly $C_{10}$–$C_{20}$ alpha-olefins, with $SO_3$ and then neutralizing and hydrolyzing the reaction product. The preferred anionic detergents are sodium ($C_{10}$–$C_{16}$) linear alkyl benzene sulfonates, ($C_{10}$–$C_{18}$) alkyl polyethoxy sulfates and mixtures thereof.

The more preferred anionic detergent is a mixture of linear or branched (preferably linear) higher alkylbenzene sulfonate and alkyl polyethoxy sulfate. While other water soluble linear higher alkylbenzene sulfonates may also be present in the formulas of the present invention, such as potassium salts and in some instances the ammonium and/or alkanolammonium salts, where appropriate, it has been found that the sodium salt is highly preferred, which is also in the case with respect to the alkyl polyethoxy sulfate detergent component. The alkylbenzene sulfonate is one wherein the higher alkyl group is of 10 to 16 carbon atoms, preferably 12 to 15, more preferably 12 to 13 carbon atoms. The alkyl polyethoxy sulfate, which also may be referred to as a sulfated polyethoxylated higher linear alcohol or the sulfated condensation product of a higher fatty alcohol and ethylene oxide or polyethylene glycol, is one wherein the alkyl group is of 10 to 18 carbon atoms, preferably 12 to 15 carbon atoms, and which includes 2 to 11 ethylene oxide groups, preferably 2 to 7, more preferably 3 to 5 and most preferably about 3 ethylene oxide groups.

The anionic detergent is present in the composition at a level of from about 3 to about 25% by weight, more preferably from about 5 to about 20% by weight. Where mixtures of two or more different anionic detergents are used, such as the sulfate and sulfonate mixtures described above, they may be mixed in the relative proportions in the range of about 5 to 95% by weight of each type.

The composition of this invention may also contain supplementary nonionic and amphoteric surfactants. Suitable nonionic surfactants include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phosphine oxides, dialkyl sulfoxides, fatty ($C_8$–$C_{18}$) esters of glycerol, sorbitan and the like, ethoxylated glyceryl esters, ethoxylated sorbitans and ethoxylated phosphate esters.

The preferred non-ionic detergent compounds are those of the ethoxylated and mixed ethoxylated-propyloxylated ($C_6$–$C_{18}$) fatty alcohol type. The nonionic surfactants may be present in the composition at a preferred level of from about 1 to 15% by weight.

It is also possible to include an alkali metal soap of a mono- or di-carboxylic acid, especially a soap of an acid having from 12 to 18 carbon atoms, for example oleic acid, ricinoleic acid, alk(en)yl succinate, for example dodecyl succinate, and fatty acids derived from castor oil, rapeseed oil, groundnut oil, coconut oil, palmkernel oil or mixtures thereof. The sodium or potassium soaps of these acids can be used. When used, the level of soap in compositions of the invention is from about 1 to 15% by weight of the composition.

Particularly preferred combinations of surfactants include:

1. A mixture which comprises (6 to 12%) linear alkylbenzene sulfonate having from about 10 to 16 carbon atoms and (1 to 5%) of alkyl polyethoxy sulfate wherein the alkyl is of 10 to 18 carbon atoms and the polyethoxy is of 2 to 7 ethylene oxide groups.
2. A mixture which comprises an anionic $C_{10}$–$C_{18}$ alkyl polyethoxy sulfate and a nonionic ethoyxlated fatty alcohol wherein the fatty alcohol is of 8 to 18 carbon atoms and the polyethoxy is of 2 to 7 oxide groups. The anionic to nonionic surfactant ratio is from about 1:4 to 10:1, the total amount of surfactant being in the range of from about 5 to 25% by weight.
3. The composition of §2 which further comprises from about 0 to 8% of soap, preferably from 0.5 to 8% soap.

A more detailed illustration of the various detergents and classes of detergents mentioned may be found in the text *Surface Active Agents,* Vol. II, by Schwartz, Perry and Berch (Interscience Publishers, 1958), in a series of annual publications entitled *McCutcheon's Detergents and Emulsifiers,* issued in 1969, or in *Tensid-Taschenbuch,* H. Stache, 2nd Edn. Carl Hanser Verlag, Munich and Vienna, 1981.

The composition of this invention also includes at least one detergency builder. Suitable builders include phosphorus-containing inorganic salts, organic builders and non-phosphorous-containing builders. The prime function of the builder is to complex with hard water cations which form salts insoluble in water, for examples calcium and magnesium cations, through the mechanism of sequestration or cation exchange.

Examples of phosphorous-containing inorganic detergency builders include the water-soluble salts, especially alkali metalpyrophosphates, orthophosphates, polyphosphates and phosphonates. Specific examples of inorganic phosphate builders include sodium and potassium tripolyphosphates, phosphates and hexametaphophates. Phosphonate sequestrant builders may also be used. Examples of organic detergency builders which may be used include the alkali metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids, tartrate mono succinate, tartrate di succinate and citric acid. Other organic detergency builders include water-soluble alkali metal carbonates and bicarbonates, as well as mixtures thereof with phosphates, e.g., a mixture of sodium carbonate and sodium tripolyphosphate.

In a more preferred embodiment of this invention, the liquid detergent is free of environmentally damaging phosphorous-containing builders. Preferred builders for use in phosphorus-free compositions include alkali metal silicates in finely divided form, and particularly cation-exchange amorphous or crystalline aluminosilicates (zeolites) of natural or synthetic origin. Suitable aluminosilicate zeolites include "zeolite A", "zeolite B", "zeolite X", "zeolite Y" and "zeolite HS". The more preferred zeolite is crystalline sodium silicoaluminate zeolite A. Preferably, the zeolite should be in a finely divided state with the ultimate particle diameters being up to 20 microns, e.g., 0.005 to 20 microns, preferably being from 0.01 to 15 microns and especially preferably of 0.01 to 8 microns mean particle size, e.g. 3 to 7 microns, if crystalline, and 0.01 to 0.1 microns if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not be sufficiently and satisfactorily suspended.

Mixtures containing two or more of the above described detergency builders may also be employed. The builder or mixture of builders may be present in the composition in the range of from about 5 to about 40% by weight of the composition, more preferably from about 8 to about 30% by weight. Where the builder is a zeolite material, it is normally present in the range of from about 10 to 30% by weight of the composition, and may be used in combination with other compatible builder materials.

The key component of liquid detergent compositions of the present invention which gives rise to the above described viscosity modification properties is the oxidized polysaccharide component. This material may be generally described as the oxidation product of a polysaccharide containing terminal aldehyde functionality and selected from the group consisting of disaccharides, trisaccharides, starch hydrolysates, cellulose and hemicellulose hydrolysates, and mixtures thereof. Catalytic oxidation of these materials is conducted such that the terminal aldehyde functionality is selectively oxidized resulting in substantial conversion of the aldehyde functionality into aldonic or glyconic acid functionality to the extent that the acid index value of the oxidized product ranges from about 1 to 20, expressed as the number of grams of carboxylic functionality per 100 grams of oxidized polysaccharide.

Preferred oxidized polysaccharides may be prepared by way of the selective catalytic oxidation process disclosed in European Patent 232,202 using one or more of the following starting materials:

- disaccharides including lactose, maltose, isomaltose, cellobiose, xylobiose and mannobiose having terminal aldehyde functionality;
- starch hydrolysates prepared by acidic or enzymatic hydrolysis;
- hydrolysis products of cellulose or hemicellulose such as the D-galacto-D-mannanes, the D-gluco-D-mannanes, the L-arabino-D-xylanes and the D-xylo-L-arabinanes.

The more preferred material is the oxidation product of starch hydrolysate having a Dextrose Equivalent (DE) from about 5 to 90, more preferably from about 20 to 65 and most preferably from about 35 to 65, which oxidation product is characterized by an acid index value (AI) of from about 1 to 20, more preferably from about 5 to 14 and most preferably from about 7 to 14. These indexes are calculated by the following formulae:

$$DE = \frac{\text{Reducing Sugar Content as Dextrose}}{\text{Total Solids}} \times 100$$

and $$AI = \frac{DE \times 45/180}{100 + (DE \times 218/180) - DE} \times 100$$

The oxidized polysaccharide component may also be further hydrogenated to lower the content of reducing sugars to below 0.6%, more preferably to below 0.05%. This treatment tends to stabilize the color of the material and prevent "yellowing" of the material when in contact with alkaline pH or at high temperatures. Hydrogenation may be conducted by conventional techniques such as contact of the oxidized polysaccharide with a hydrogenation catalyst such as Raney nickel in the presence of hydrogen gas.

The oxidized polysaccharides useful in accordance with this invention and the methods for preparing them are more specifically disclosed in Canadian Patents 2,028,284 and 2,038,640, and EP 232,202. They are also commercially available from Roquette Freres Company of France.

The oxidized polysaccharide (OPS) may be blended into the liquid detergent compositions at levels generally in the range of from about 0.25 to about 5% by weight. Where used as the sole viscosity modifier, optimal control of product viscosity is achieved at OPS levels of from about 1 to 3.5% by weight, more preferably from about 1.5 to 3.5% by weight.

It has also been found that a synergy exists when the OPS is used in combination with an alkali metal salt of an acrylic polymer for control of both the viscosity and flowability of the liquid detergent, as well as the stability. Suitable acrylic polymers include water dispersible alkali metal salts of polyacrylic or polymethacrylic acid or copolymers of at least 50% acrylic or methacrylic acid and a second comonomer such as maleic acid, maleic anhydride, vinyl acetate, or itaconic acid, as well as mixtures thereof. Preferred acrylic polymer salts have a mass molecular weight in the range of from about 500 to about 10,000, more preferably from about 1,000 to about 5,000, and have at least about 50% by weight of the acid functionality neutralized with an alkali metal cation, e.g., sodium.

These acrylic polymers are generally known as viscosity modifiers for use in liquid detergents, as disclosed for example in U.S. Pat. Nos. 4,715,969 and 5,205,957, as well as EP 301,882. They are not readily biodegradable. However, their use in combination with the OPS component provides for excellent viscosity modification at levels generally below levels of acrylic polymer which would be otherwise required to achieve target viscosity modification without the OPS component. Where present in the composition, the acrylic polymers are added at levels generally in the range of from about 0.1 up to about 2.5% by weight, more preferably from about 0.15 to about 1.5% by weight, and most preferably from about 0.25 to about 0.75% by weight. In the more preferred embodiment, the OPS component and acrylic polymer are added to the liquid detergent at a respective weight ratio in the range of from about 0.5:1 up to about 10:1, most preferably at a ratio of from 1:1 up to 5:1.

The liquid detergent composition of the invention may also optionally contain a swelling bentonite clay material as a fabric softening agent. These materials are colloidal clays (aluminum silicate) containing montmorillonite, available as sodium bentonite or calcium bentonite. These materials generally form a swellable colloidal suspension when mixed with water, which property can also aid in maintaining insoluble particulate materials, i.e., zeolites, suspended in the liquid medium. Where present in the composition, the bentonite is added at level in the range of from about 1 to about 15% by weight.

The only other required component of the liquid detergent compositions in accordance with the present invention is water. Normally the hardness content of such water will be less than about 400 ppm as $CaCO_3$. Sometimes it may be desirable to utilize deionized water although city water will be satisfactory. While harder waters may be successfully employed in making the liquid detergent compositions of the present invention, it is considered that soft waters have less likelihood of producing some objectionable materials which could adversely affect the appearance of the liquid detergent or which could deposit objectionably on laundry during washing. The quantity of water present in the composition will generally range from about 25 to 70% by weight water. In more highly concentrated compositions, the quantity of water may range from about 25 to 50% by weight.

Various adjuvants both aesthetic and functional, may be present in the liquid detergent compositions of the present invention, such as fluorescent brighteners, perfumes and colorants. The fluorescent brighteners include the well known stilbene derivatives, including the cotton and nylon brighteners, such as those sold under the trademark Tinopal, e.g. 5BM. The perfumes that are employed usually include essential oils, esters, aldehydes and/or alcohols, all of which are known in the perfumery art. The colorants may include dyes and water dispersible pigments of various types, including ultramarine blue. Because of the lightening effect due to the presence of the bentonite in the liquid detergent, colors of the product may often be attractive pastels. Titanium dioxide may be utilized to lighten the color of the product further or to whiten it. Inorganic filler salts, such as sodium sulfate and sodium chloride may be present, as may be antiredeposition agents, such as sodium carboxy-methylcellulose; enzymes, such as proteases, amylases and lipases; bleaches, such as sodium perborate or percarbonate or chlorine-containing materials; bactericides; fungicides; anti-foam agents, such as silicones; antisoiling agents, such as copolyesters; preservatives, such as formalin; foam stabilizers, such as lauric myristic diethanolamide; and auxiliary solvents, such as ethanol. Normally the individual proportions of such adjuvants will be less than 3%, often less than 1% and sometimes even less than 0.5%, except for any fillers and solvents, and additional detergents and builders, for which the proportions may sometimes be as high as 10%. The total proportion of adjuvants, including non-designated synthetic detergents and builders, will normally be no more than 20% of the product and desirably will be less than 10% thereof, more desirably less than 5% thereof. Of course, the adjuvants employed will be non-interfering with the washing and softening actions of the liquid detergent and will not promote instability of the product on standing. Also, they will not cause the production of objectionable deposits on the laundry.

The viscosity of the liquid detergent composition immediately after completion of the formulation mixing procedure will generally range from about 1,000 to 20,000 centipoises (cps) , measured using a Brookfield Viscosimeter Model DV-II at an angular velocity of 10 rpm and at 25° C.

Spindle n° 3 is used to measure viscosities below 10,000 cps and spindle n° 4 is used for viscosities above 10,000 cps. The more preferred viscosity will be in the range of from about 2,000 to 10,000 cps, most preferably in the range of 3,000 to 6,000 cps. The pH of the composition will generally be in the range of from about 7 to about 11, preferably 7.5 to 8.5, and pH may be adjusted if necessary by adding appropriate amounts of a basic solution such as 50% KOH.

The following examples are illustrative of the invention. Unless otherwise indicated, all parts are by weight

EXAMPLE

A super concentrated heavy duty liquid detergent formulation having the following composition was prepared:

| Components | Percent (as actives) |
|---|---|
| Borax, granular | 3.0 |
| Calcium Chloride, dehydrate | 0.4 |
| Pigment (CI Pigment Blue 15/CI 74160 [BASF]) | 0.008 |
| Nonionic = C12–C14 fatty alcohol with 3 moles ethylene oxide (Empilan KB3 [Marchon]) | 3.8 |
| KOH caustic potash (50%) | 1.1 |
| Calcium Clay (Bentonite QPCC300 [Colin Stewart Minerals]) | 5.0 |
| Oleic Acid | 3.0 |
| Cyclomethicone (Silicone Antifoam S 132 [Wacker]) | 0.5 |
| Sodium Polyacrylate (MW = 2,000) (43%) | Varied |
| Oxidized Polysaccharide (MW = 540) (70%) [Roquette Freres] | Varied |
| Zeolite A | 23.0 |
| Diethylenetriamine Pentamethylene Phosphonic Acid (Dequest 2060S [Monsanto]) | 0.6 |
| Sodium alkyl polyethoxy sulfate (70%) (alkyl = linear alkyl of 12 to 15 carbon atoms; polyethoxy = 3 ethoxy groups) | 11.2 |
| Brightener 1 = Tinopal LMS-X [Ciba - Geygy] | 0.1 |
| Brightener 2 = Tinopal CBS-X [Ciba - Geygy] | 0.006 |
| Preservative = 1-(3-chloroallyl)-3,5,7-triaza-1-azoniaadamantine chloride (Dowicil 75 [Dow Chemical]) | 0.1 |

-continued

| Components | Percent (as actives) |
|---|---|
| Citric acid | 2.0 |
| Perfume = Jumelle 542 [IFF] | 1.2 |
| Protease enzyme = Durazym 16.0L [Novo Nordisk] | 0.7 |
| Water | QS to 100% |

About 85% of the formula amount of water is added to a suitable mixer, such as a vertical cylindrical tank equipped with heating and cooling means and connected to a discharge pump. The formula amounts of ingredients are added in the order as listed above with stirring using a Lightnin® type mixer. The balance of the water is added, thinning the mix, and the fragrance, enzyme and preservative are added last, with mixing. The product then is ready to be pumped out of the mixer and into end use narrow necked bottles, which serve as dispensing containers. During the mixing operation, all of which takes about nine minutes, the materials added and the final product are at a temperature of about 20° C. In some cases, to promote faster dissolving and quicker dispersion of the components, the temperature of the water and other components charged may be raised to 40° C. to 50° C., so that the final product temperature may be about 30° C. to 40° C. in which case the mixing time may be reduced to about 5 or 6 minutes.

Formula 1 represents a control detergent containing no added viscosity modifier. Formulas 2–7 contain an oxidized polysaccharide (OPS) viscosity modifier in the amounts indicated in Table I. The OPS used in Examples 2–7 (and all further examples) was obtained from Roquette Freres of France, and is a mixture of oligosaccharides produced from the hydrolysis of starch. The average molecular weight of the oligosaccharides is equivalent to three glucose units (MW of about 540). The OPS is chemically characterized by a Dextrose Equivalent value of 37 and an acid index value of about 8.6 carboxylate functions per 100 g of OPS.

The various formulations were aged for periods up to one month at room temperature, 4° C., 35° C. and 43° C. During the aging, the products were evaluated for viscosity, flowability and stability according to the following methodology:

* Brookfield Viscosity

Product viscosity is measured with a Brookfield Viscosimeter Model DV-II at an angular velocity of 10 rpm. The spindle n° 3 is used to measure viscosities below 10,000 cPs. The spindle n° 4 is used for viscosities above 10,000 cps.

* Flowability (Raymond Flowmeter)

The flowability is assessed by the time required for 50 ml of the product to flow under normal gravity through a 8 cm length Inox tube having an internal diameter of 6 mm. A product is "flowable" if the test does not exceed 50 seconds.

* Stability

A product is stable if no more than 3% of the total volume separates from the bulk within one month at RT, 4° C., 35° C. and 43° C. under normal gravity. The structure of the product has to be smooth and homogeneous, no cracks being visible at the completion of the aging time.

Table I shows the rheological properties for compositions containing different levels of OPS.

Incorporated alone, OPS delivers more stable products with low viscosity and good flowability as shown in Table I. At the level of 1.5 nominal-% of OPS in the composition, a strong decrease of the viscosity together with an improved stability is clearly observed in Formula 4. An optimal control of the product viscosity and flowability is obtained at 2.5 nominal-% of OPS as shown in Formula 6.

TABLE 1

| Formula | OPS (nominal-%) | Stability | Viscosity (cPs)/ Raymond Flowability (s) After Making | 1 week |
|---|---|---|---|---|
| 1 | 0.0 | Unstable | 14,600/nd | 9,700/nd |
| 2 | 0.5 | Unstabte | 16,300/nd | 13,000/nd |
| 3 | 1.0 | Stable | 17,500/nd | 17,400/nd |
| 4 | 1.5 | Stable | 5,900/51 | 7,200/91 |
| 5 | 2.0 | Stable | 5,200/50 | 7,800/86 |
| 6 | 2.5 | Stable | 4,800/30 | 4,500/41 |
| 7 | 3.0 | Stable | 6,000/33 | 5,300/36 |

nd = not determined

Five additional formulations designated as Formulas 8–12 were prepared which contained a mixture of the OPS component and a sodium polyacrylate in the amounts indicated in Table 2. The stability, viscosity and flowability of these formulations are compared with Formulas 1, 3 and 5 and results are shown in Table 2.

A synergy is found when the OPS is used together with a secondary polymer to control successfully both the viscosity/flowability and the stability of the product. Superiority over single polyacrylate or OPS compositions is evidenced for a composition containing 0.45% Norasol LMW20 and 1 or 2% OPS (compare Formulas 8 and 3 with Formula 10 as well as Formulas 8 and 5 with Formula 12). The level of polyacrylate can be slightly modified to fine tune the final product viscosity and flowability as shown in Formulas 9 and 11.

TABLE 2

| Formula | OPS (nominal-%) | Norasol LMW20(1) (nominal-%) | Stability | Viscosity (cPs)/Raymond Flowability (s) After making | 1 week | 1 month |
|---|---|---|---|---|---|---|
| 1 | 0.0 | 0.00 | Unstable | 14,600/nd | 9,700/nd | 9,500/195 |
| 8 | 0.0 | 0.45 | Unstable | 5,800/38 | 8,300/125 | 8,300/125 |
| 3 | 1.0 | 0.00 | Stable | 17,500/nd | 17,400/nd | 15,100/nd |
| 9 | 1.0 | 0.30 | Stable | 6,000/37 | 5,400/43 | 5,200/36 |
| 10 | 1.0 | 0.45 | Stable | 5,700/34 | 4,800/27 | 4,300/24 |
| 11 | 1.0 | 0.60 | Stable | 6,700/38 | 6,000/32 | 5,900/34 |
| 5 | 2.0 | 0.00 | Stable | 5,200/50 | 7,800/86 | 6,100/85 |

TABLE 2-continued

| Formula | OPS (nominal-%) | Norasol LMW20[1] (nominal-%) | Stability | Viscosity (cPs)/Raymond Flowability (s) After making | 1 week | 1 month |
|---|---|---|---|---|---|---|
| 12 | 2.0 | 0.45 | Stable | 8,300/67 | 6,600/39 | 6,000/34 |

nd = not determined
[1]Norasol LMW20 is a polycrylate having a mass-MW about 2,000 from NORSOHAAS Four additional formulations designated Formulas 13–16 were prepared which contained a mixture of OPS component and various sodium acrylate polymers as set forth in Table 3. The stability, viscosity and flowability of these formulations are compared with Formulas 3 and 10 and results are shown in Table 3.

The data in Table 3 shows that the second viscosity reducing polymer can be either a conventional sodium acrylate having a varied molecular weight (Formulas 13, 10 and 14), a sodium acrylate/maleate copolymer (Formula 15) or a mixture of sodium acrylate copolymers (Formula 16).

TABLE 3

| Formula | OPS (nominal-%) | Second Viscosity reducing polymer Type | mass-MW | Level (%) | Stability | viscosity (cPs)/Raymond Flowability (s) After making | 1 week | 1 month |
|---|---|---|---|---|---|---|---|---|
| 3 | 1.0 | — | — | — | Stable | 17,500/nd | 17,400/nd | 15,100/nd |
| 13 | 1.0 | Norasol LMW10 | 1,000 | 0.45 | Stable | 8,700/120 | 6,700/48 | 5,300/43 |
| 10 | 1.0 | Norasol LMW20 | 2,000 | 0.45 | Stable | 5,700/34 | 4,800/27 | 4,300/24 |
| 14 | 1.0 | Norasol LMW45 | 4,500 | 0.45 | Stable | 6,700/33 | 5,800/39 | 5,700/47 |
| 15 | 1.0 | Sokalan CP12 | 4,000 | 0.45 | Stable | 5,100/28 | 5,300/48 | 5,300/50 |
| 16 | 1.0 | LMW10/LMW20 | | 0.65/0.45 | Stable | 8,300/nd | 8,300/71 | 7,800/53 |

nd = not determined
Norasols TM are polyacrylates manufactured by NORSOHAAS
Sokalan CP12 is an acrylate/maleate copolymer manufactured by BASF

What is claimed is:

1. A heavy duty liquid detergent composition having a viscosity in the range of from about 1,000 to 20,000 cps comprising a homogeneous mixture of:

a) at least one water soluble anionic sulfate or sulfonate organic detergent;

b) at least one detergent builder;

c) from about 1 to about 5% by weight of an oxidized polysaccharide viscosity modifier having an acid index value of from about 1 to 20, expressed as the number of grams of carboxylic functionality per 100 grams of oxidized polysaccharide;

d) from 0 to about 1.5% by weight of a an alkali metal salt of an acrylic polymer having a mass molecular weight in the range of from about 500 to 10,000; and e) from about 25 to about 70% by weight of water;

said composition further characterized by the fact that it exhibits a lower viscosity than an otherwise identical composition which does not contain said oxidized polysaccharide viscosity modifier.

2. The composition of claim 1 having a viscosity in the range of from about 2,000 to 10,000 cps.

3. The composition of claim 1 wherein said anionic organic detergent comprises from about 3 to 25% by weight of a sodium or potassium alkyl polyethoxy sulfate wherein the alkyl group contains from about 8 to 22 carbon atoms and the polyethoxy is of 2 to 7 ethylene oxide groups.

4. The composition of claim 1 wherein said anionic organic detergent comprises from about 3 to 25% by weight of an alkyl benzene sulfonate having from about 9 to 20 alkyl carbon atoms.

5. The composition of claim 3 wherein said anionic organic detergent comprises a mixture of said sulfate and an alkyl benzene sulfonate having from about 9 to 20 alkyl carbon atoms.

6. The composition of claim 3 wherein said organic detergent comprises a mixture of said sulfate and a nonionic ethoxylated fatty alcohol wherein the fatty alcohol contains 8–18 carbon atoms.

7. The composition of claim 6 further containing from 0 to 8% by weight of a soap.

8. The composition of claim 1 wherein said oxidized polysaccharides are selected from the group consisting of the glyconic acid oxidation products of one or a mixture of disaccharides, trisaccharides, and the hydrolysates of starch, cellulose and hemi-cellulose.

9. The composition of claim 8 wherein said oxidized polysaccharide has an acid index in the range of from about 5 to 14 and is the oxidation product of a starch hydrolysate having a dextrose equivalent value in the range of from about 20 to 65.

10. The composition of claim 1 which is free of added phosphorus-containing compounds and which contains from about 5 to 35% by weight of an inorganic detergency builder.

11. The composition of claim 10 wherein said inorganic detergency builder comprises an aluminosilicate zeolite.

12. The composition of claim 1 containing at least about 0.05% by weight of said alkali metal salt of an acrylic polymer.

13. The composition of claim 12 wherein said polymer is a sodium acrylate polymer having a mass molecular weight of from about 1,000 to about 5,000.

14. The composition of claim 1 further containing from about 1 to about 15% by weight of a swelling bentonite clay as a softening agent.

15. A method for reducing the viscosity of a heavy duty liquid detergent composition based on a mixture comprising water, at least one anionic detergent and at least one detergent builder comprising mixing into said composition a viscosity modifier composition comprising at least one oxidized polysaccharide having an acid index of from about 1 to 20, expressed as the number of grams of carboxylic functionality per 100 grams of oxidized polysaccharide, in an amount effective to reduce the viscosity of said liquid detergent composition.

16. The method of claim 15 wherein said viscosity modifier composition further contains an alkali metal salt of an acrylic polymer having a mass molecular weight in the range of from about 500 to 10,000.

17. The method of claim 15 wherein said oxidized polysaccharide is mixed with said liquid detergent at a level in the range of about 0.25 to about 5% by weight.

18. The method of claim 16 wherein said oxidized polysaccharide is mixed with said liquid detergent at a level in the range of about 0.25 to about 5% by weight and said acrylic polymer is mixed with said liquid detergent at a level of from about 0.1 to 2.5% by weight.

19. The composition of claim 1 containing from about 1 to 3.5% by weight of said oxidized polysaccharide.

20. The method of claim 17 wherein said level is in the range of about 1 to 3.5% by weight.

21. A heavy duty liquid detergent composition having a viscosity in the range of from about 1,000 to 20,000 cps comprising a homogeneous mixture of:

a) at least one water soluble anionic sulfate or sulfonate organic detergent;

b) at least one detergent builder;

c) from about 0.25 to about 5% by weight of an oxidized polysaccharide viscosity modifier having an acid index value of from about 1 to 20, expressed as the number of grams of carboxylic functionality per 100 grams of oxidized polysaccharide;

d) from about 0.1 to about 2.5% by weight of an alkali metal salt of an acrylic polymer having a mass molecular weight in the range of from about 500 to 10,000; and e) from about 25 to about 70% by weight of water.

22. The composition of claim 21 wherein said oxidized polysaccharide is selected from the group consisting of the glyconic acid oxidation products of one or a mixture of disaccharides, trisaccharides, and the hydrolysates of starch, cellulose and hemi-cellulose, and wherein said acrylic polymer is present in said composition at a level of at least about 0.25% by weight.

* * * * *